US006519443B1

(12) United States Patent
Coriale et al.

(10) Patent No.: US 6,519,443 B1
(45) Date of Patent: Feb. 11, 2003

(54) METHOD FOR CALCULATING A PRINT MEDIUM PICK TIME FOR AN IMAGING APPARATUS THAT TRANSPORTS PRINT MEDIA AT VARIABLE SPEEDS

(75) Inventors: Matthew Christopher Coriale, Lexington, KY (US); Christopher Edward Rhoads, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/969,328

(22) Filed: Oct. 2, 2001

(51) Int. Cl.[7] ..... G03G 15/00
(52) U.S. Cl. ..... 399/388; 399/394; 399/396
(58) Field of Search ..... 399/381, 388, 399/391, 394, 396; 271/3.17, 110, 258.01

(56) References Cited

U.S. PATENT DOCUMENTS

| | | | | |
|---|---|---|---|---|
| 4,318,540 A | | 3/1982 | Paananen et al. | 271/4 |
| 4,331,328 A | | 5/1982 | Fasig | 271/270 |
| 4,451,027 A | | 5/1984 | Alper | 271/10 |
| 4,986,526 A | | 1/1991 | Dastin | 271/227 |
| 5,056,771 A | | 10/1991 | Beck et al. | 271/114 |
| 5,121,914 A | | 6/1992 | Hargreaves | 271/110 |
| 5,186,449 A | | 2/1993 | Ohmi et al. | 271/10 |
| 5,192,067 A | | 3/1993 | Saito | 271/10 |
| 5,326,184 A | | 7/1994 | Shibata | 400/624 |
| 5,415,387 A | | 5/1995 | Suzuki | 271/10 |
| 5,484,141 A | | 1/1996 | Yamashita et al. | 271/227 |
| 5,495,326 A | | 2/1996 | Mikida | 399/43 |
| 5,575,466 A | | 11/1996 | Tranquilla | 271/10.03 |
| 5,597,154 A | | 1/1997 | Yamashita | 271/10.05 |
| 5,664,771 A | | 9/1997 | Nagatani et al. | 271/10.03 |
| 5,692,741 A | | 12/1997 | Nakamura et al. | 271/10.03 |
| 5,692,742 A | | 12/1997 | Tranquilla | 271/10.03 |
| 5,920,381 A | | 7/1999 | Katsuta | 271/259 |
| 5,924,686 A | * | 7/1999 | Jacobson et al. | 271/3.17 |
| 5,983,066 A | | 11/1999 | Abe et al. | 399/394 |
| 5,988,628 A | | 11/1999 | Mori | 271/117 |
| 6,014,542 A | | 1/2000 | Hozumi et al. | 399/394 |
| 6,076,821 A | | 6/2000 | Embry et al. | 271/10.01 |
| 6,098,536 A | | 8/2000 | Ohkawa | 101/118 |
| 6,137,989 A | | 10/2000 | Quesnel | 399/394 |
| 6,151,478 A | | 11/2000 | Katsuta et al. | 399/372 |
| 6,181,907 B1 | * | 1/2001 | Hong | 399/394 |
| 6,185,396 B1 | | 2/2001 | Aizawa et al. | 399/121 |
| 6,237,485 B1 | * | 5/2001 | Fukai | 271/258.02 |
| 6,327,458 B1 | * | 12/2001 | Chapman | 399/394 |

* cited by examiner

*Primary Examiner*—Hoan Tran
(74) *Attorney, Agent, or Firm*—Taylor & Aust, P.C.

(57) ABSTRACT

A method for calculating a print medium pick time for an imaging apparatus that transports media at variable speeds along a media path, includes the steps of providing a staging process for varying a transport velocity of a media sheet before transferring an image to the media sheet at the image transfer location, the staging process being used for positioning a top writing line margin of the media sheet in relation to the image at the image transfer location; determining a time period $t_1$ corresponding to a time when a pick motor is started to pick the media sheet to a time when the staging process is started; determining a derived time period $t_2$ representative of a normalized time from when the staging process is started to a time when a media path sensor senses the media sheet; and determining a compensated calculated pick time for the media sheet by summing the time period $t_1$ with the time period $t_2$.

26 Claims, 1 Drawing Sheet

METHOD FOR CALCULATING A PRINT MEDIUM PICK TIME FOR AN IMAGING APPARATUS THAT TRANSPORTS PRINT MEDIA AT VARIABLE SPEEDS

BACKGROUND OF THE INVENTION

1. Field of the Invention

The present invention relates to imaging systems, and, more particularly, to a method for calculating a print medium pick time for an imaging apparatus, such as an electrophotographic machine, that transports print media at variable speeds.

2. Description of the Related Art

In known electrophotographic machines, a sheet of paper is picked from an input device, such as a paper tray, prior to the start of the imaging process on a developing unit. As the paper moves through the paper path at a constant speed, the leading edge of the paper eventually actuates a paper path sensor which signals the machine to commence imaging onto the developing unit. The image is laid down on a single rotating photoconductive drum in the developing unit. Eventually, the image on the drum is transferred to a transfer medium and then onto a sheet of paper which contacts the transfer medium at a precise point in time in order to establish a desired top writing line margin. This process is repeated for each individual sheet of paper, allowing the machine the luxury of waiting until each page is at a known location in the paper path before beginning the imaging process. Since the paper is picked prior to imaging, thereby allowing the electrophotographic process to wait for the paper to arrive at a certain location before commencing imaging, the margin above the top writing line on the paper can be accurately controlled.

It may be desirable or necessary to design an electrophotographic machine such that imaging is begun on a developing unit before the sheet of paper is even picked from the input device. This requirement may be due to size limitations on the printer which reduce the maximum length of the paper path. It may also be due to the use of multiple developing units, each transferring an image of a respective color onto a same location on the transfer medium. That is, after an image is first scanned onto a photoconductive drum for a first color, the image is transferred onto an intermediate transfer medium belt. The belt then moves over to receive an image of a second color from a second photoconductive drum. The second image is received on top of and overlaps the first image. This process repeats for each of the photoconductive drums, and the completed composite image eventually reaches the paper transfer nip where it is transferred from the intermediate transfer medium belt onto the paper. Since additional time is required for transferring a separate image from each developing unit sequentially, it may be necessary to begin imaging on at least a first of the developing units before the paper is picked from the input device.

A variable sheet transfer velocity profile is used in order to allow a sheet of print medium picked from a given media source tray to arrive at the image transfer location at the proper time and at the proper velocity to accommodate an accurate location of the top margin of the image to the sheet. Such a use of a variable sheet transfer velocity profile, however, complicates the task of picking a sheet of print medium from a given tray at an appropriate time.

What is needed in the art is a method for calculating a print medium pick time for an imaging apparatus, such as an electrophotographic machine, that transports print media at variable speeds.

SUMMARY OF THE INVENTION

The present invention provides a method for calculating a print medium pick time for an imaging apparatus, such as an electrophotographic machine, that transports print media at variable speeds.

The invention comprises, in one form thereof, a method for calculating a print medium pick time for an imaging apparatus that transports media at variable speeds along a media path. The method includes the steps of providing a media path sensor for sensing an arrival of a media sheet at a known location along the media path; providing an image on an image transfer member; providing an image transfer location adjacent the media path; providing a staging process for varying a transport velocity of the media sheet before transferring the image to the media sheet at the image transfer location, the staging process being used for positioning a top writing line margin of the media sheet in relation to the image at the image transfer location; determining a time period $t_1$ corresponding to a time when a pick motor is started to pick the media sheet to a time when the staging process is started; determining a derived time period $t_2$ representative of a normalized time from when the staging process is started to a time when the media path sensor senses the media sheet; and determining a compensated calculated pick time for the media sheet by summing the time period $t_1$ with the time period $t_2$.

In another form thereof, the invention comprises a printer. The printer includes a media tray for holding media sheets. A pick motor is provided for picking a media sheet from the media tray. A staging system is provided and includes a staging motor operating in accordance with a staging process effecting a staging algorithm for transporting the media sheet along a media path. A staging motor encoder is coupled to the staging system for determining a distance traveled by the media sheet. A sensor is provided for sensing an arrival of the media sheet at a known location along the media path. A microcontroller is provided for executing computer instructions to determine a compensated calculated pick time ($CPTcom_x$) for the media sheet, the computer instructions effecting the equation:

$$CPTcom_x = Staging_Encoders_From_Staging_Algorithm_Start_To_S2_Make/Staging_Encoders_Per_Second_At_Normal_Process_Speed + Staging_Start_TimeStamp_Pick_Start_TimeStamp$$

wherein:

- Staging_Encoders_From_Staging_Algorithm_Start_To_S2_Make is a number of staging motor encoder pulses counted from when the staging algorithm starts until the sensor detects the media sheet;
- Staging_Encoders_Per_Second_At_Normal_Process_Speed is set to a number of encoder pulses per second that should occur if the staging motor was rotating at a known process speed;
- $Staging_{13}$ $Start_{13}$ TimeStamp is a system time of the printer when the staging algorithm is started; and
- Pick_Start_TimeStamp is a system time of the printer when the pick motor is started.

An advantage of the present invention is that an accurate pick time can be established for a media sheet in an imaging system that transports print media sheets at variable speeds.

Another advantage of the present invention is that it minimizes the need to make extreme staging changes in positioning a media sheet in relation to an image.

Still another advantage is that the present invention can be implemented using existing hardware within the imaging apparatus.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Figure 1:
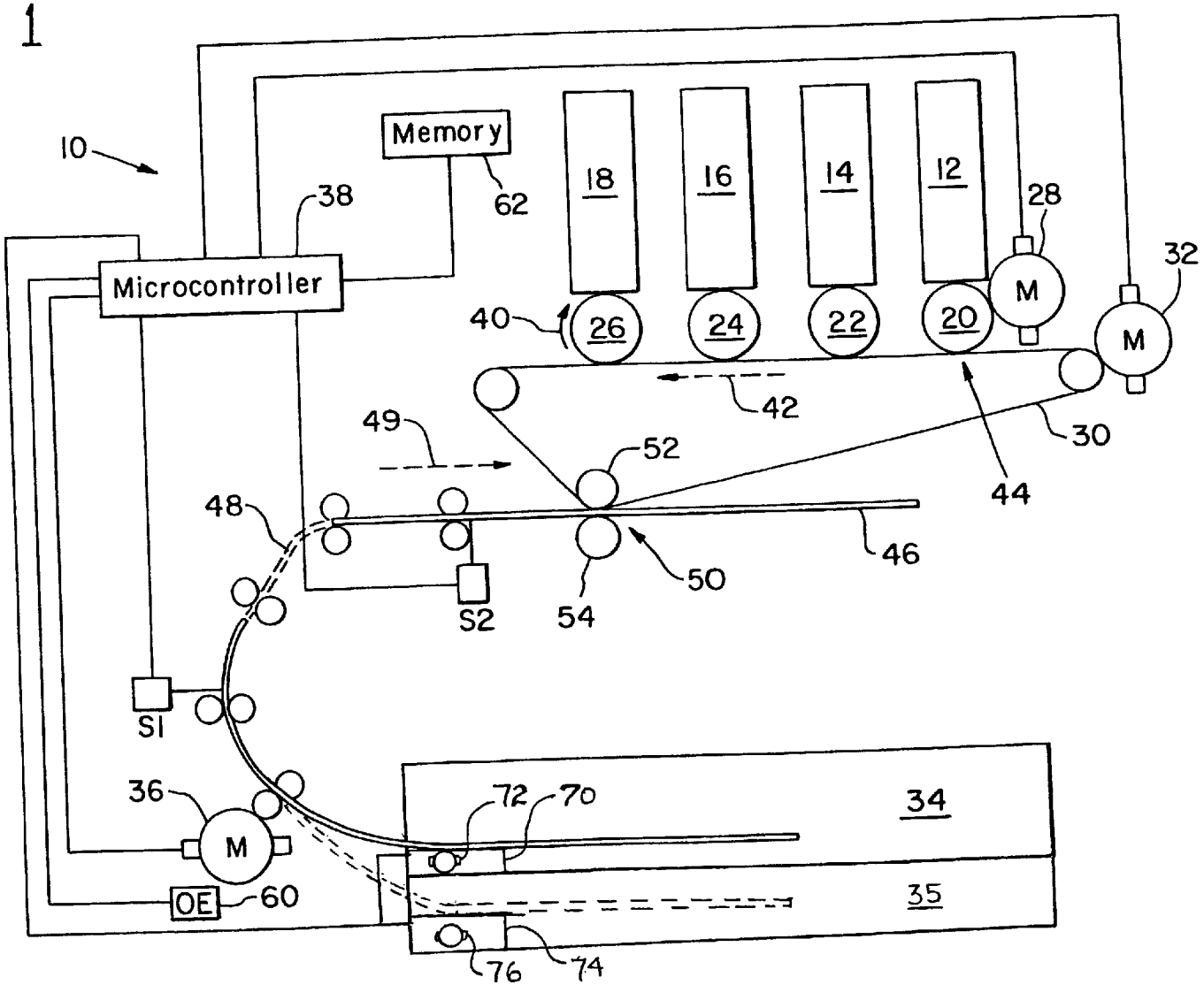
FIG. 1 is a partial, schematic, side view of one embodiment of a laser printer in which the method of the present invention may be used.

The exemplification set out herein illustrates one preferred embodiment of the invention, in one form, and such exemplification is not to be construed as limiting the scope of the invention in any manner.

DETAILED DESCRIPTION OF THE INVENTION

In FIG. 1 there is shown one embodiment of a multicolor laser printer 10 including toner cartridges 12, 14, 16, 18, photoconductive drums 20, 22, 24, 26, a drum motor 28, an intermediate transfer member belt 30, a belt motor 32, an input media tray 34, an input media tray 35, a staging motor 36, media path sensors S1 and S2, and a microcontroller 38.

Each of four laser print heads (not shown) scans a respective laser beam in a scan direction, perpendicular to the plane of FIG. 1, across a respective one of photoconductive drums 20, 22, 24 and 26. Each of photoconductive drums 20, 22, 24 and 26 is negatively charged to approximately −900 volts and is subsequently discharged to a level of approximately −200 volts in the areas of its peripheral surface that are impinged by a respective one of the laser beams. During each scan of a laser beam across a photoconductive drum, each of photoconductive drums 20, 22, 24 and 26 is continuously rotated, clockwise in the embodiment shown, in a process or "cross-scan" direction indicated by direction arrow 40. The scanning of the laser beams across the peripheral surfaces of the photoconductive drums is cyclically repeated, thereby discharging the areas of the peripheral surfaces on which the laser beams impinge.

The toner in each of toner cartridges 12, 14, 16 and 18 is of a separate, respective color, such as cyan, magenta, yellow and black. Thus, each of the four laser print heads controls printing in a respective color, such as cyan, magenta, yellow or black. Further, the toner in each of toner cartridges 12, 14, 16 and 18 is negatively charged to approximately −600 volts. Thus, when the toner from cartridges 12, 14, 16 and 18 is brought into contact with a respective one of photoconductive drums 20, 22, 24 and 26, the toner is attracted to and adheres to the portions of the peripheral surfaces of the drums that have been discharged to −200 volts by the laser beams. As belt 30 rotates in the direction indicated by arrow 42, the toner from each of drums 20, 22, 24 and 26 is transferred to the outside surface of belt 30 in a respective drum transfer nip 44. The direction indicated by arrow 42 is also known as the process direction of belt 30. As a print medium, such as paper 46, travels along a media path 48 in the direction indicated by arrow 49, the toner is transferred from belt 30 to the surface of the paper 46 in an image transfer nip 50 between opposing rollers 52 and 54. Image transfer nip 50 is also know as a"toner transfer nip", and defines an image transfer location.

Imaging may begin, for example, at least on first photoconductive drum 20, before a first sheet of paper 46 is picked from one of input media trays 34, 35. The image begins to be transferred onto transfer belt 30, and when the image on belt 30 reaches a point that is a certain distance away from image transfer nip 50, one of input media trays 34, 35 receives a pick command from microcontroller 38.

Microcontroller 38 includes, for example, a microprocessor, random access memory (RAM), read only memory (ROM) and an input/output (I/O) interface.

Microcontroller 38 determines when the electrophotographic system begins to image on at least one of photoconductive drums 20, 22, 24 and 26. Microcontroller 38 tracks the first line position on photoconductive drum 20, if color, or on photoconductive drum 26, if monochrome, and the first line position on transfer belt 30, using feedback from the black laser print head associated with photoconductive drum 26. It is to be understood that the color print heads associated with color photoconductive drums 20, 22 and 24 are synchronized with respect to the black print head. Drum motor 28 drives photoconductive drum 20. Drum motor 28 may or may not also drive drums 22, 24 and 26.

Microcontroller 38 provides a velocity command to belt motor 32, and belt motor 32 responds by achieving the commanded velocity. As a result, an assumed velocity of transfer belt 30 is achieved, and accordingly, a location of an image formed on transfer belt 30 is known based on the assumed velocity.

At some designated time, a designated one of input media trays 34, 35 receives a command from microcontroller 38 to pick a sheet of print media, such as paper. The sheet of paper moves through media path 48 at a constant speed and eventually actuates a paper path sensor S1. Microcontroller 38 immediately begins tracking incrementally the position of the paper by monitoring the feedback of a staging motor encoder 60, this one being associated with staging motor 36. From the tracked distance traveled by the sheet of paper after tripping paper path sensor S1, and the known distance between S1 and image transfer nip 50, the distance remaining for the sheet of paper to travel before reaching image transfer nip 50 can be calculated.

The inter-sheet gap is small in comparison to the media path length and the image path length. Thus, no adjustment to media position can begin until the preceding sheet has been completely cleared from media path 48. This is determined by monitoring another media path sensor S2. By monitoring when the trailing edge of the preceding sheet has cleared sensor S2, microcontroller 38 can determine when the preceding sheet has exited the last driven rolls of motor 36, thereby allowing the correction of the position error of the current sheet to begin, which is referred to herein as a staging process.

From the two calculated distances, i.e., from the image on belt 30 to image transfer nip 50 and from the current sheet of paper to image transfer nip 50, microcontroller 38 calculates a correction needed to remove position error of the paper relative to its image so as to enable the paper to arrive at image transfer nip 50 at the time and speed required to produce an accurate top writing line margin with acceptable tolerance. The correction is accomplished by incrementally adjusting the linear speed of the media through media path 48 by incrementally changing the velocity of staging motor 36. The speed of staging motor 36 is increased or decreased depending upon whether the current sheet of paper is behind or ahead of a desired, target position.

Microcontroller 38 generates a fixed time interrupt every 1 millisecond (ms), at which time the error in the relationship between the image position and the paper position is determined. This position error is multiplied by a gain factor in a control equation that produces a new desired velocity for staging motor 36. If the error is zero, the velocity of staging motor 36 is not changed from the nominal. If the sheet of paper is ahead of or behind the desired position, a new paper path motor speed that would reduce the error for that sampling point is calculated by a staging algorithm of the staging process as implemented by microcontroller 38. As the position error decreases, the amount of velocity change also decreases to the point that zero error produces the nominal velocity. The new, changed speed of staging motor 36 is limited by minimum and maximum values in order to allow for reasonable power requirements, acceptable acoustics, and a stable control system. This also bounds the amount of error that can be removed.

The new desired speed is then fed into a motor speed control algorithm, i.e., staging algorithm, executed within microcontroller 38. Feedback from staging motor encoder 60 is used to maintain the speed of staging motor 36 at the new desired speed, which may be unchanged if the sheet of paper is already"on schedule", i.e., at a proper point along media path 48 in order to arrive at image transfer nip 50 at the desired point in time and at the desired speed. A signal from encoder 60 is used as another interrupt into microcontroller 38. Again, the timing of the interrupt is chosen such that minimum bandwidth is required, e.g., approximately 1 ms between interrupts. The control code within microcontroller 38 sets the gain, encoder divide-by values (which sets interrupt timing), and other control parameters based upon the newly requested speed from the error correction routine. Each time microcontroller 38 receives this interrupt, microcontroller 38 uses the parameters to adjust the voltage applied to staging motor 36 in order to maintain the desired speed.

The desired speed of staging motor 36 is updated by microcontroller 38 at each 1 ms timer interrupt. These updates continue until the remaining time until the sheet of paper reaches image transfer nip 50 is approximately 100 ms. At this time, the speed of the sheet of paper is set to normal process speed, for example 110 millimeters per second (mm/s) at 20 pages per minute (ppm), and is held constant, and the image is transferred onto the sheet of paper with a correct top writing line margin that is within the acceptable tolerance.

If the top writing line margin is not within the acceptable tolerance, it is possible that the error has been introduced by variances in the predetermined number of motor revolutions required to transport the paper from sensor S1 to image transfer nip 50, and/or the predetermined number of motor revolutions required for the image to travel between photoconductive drum 20 and image transfer nip 50. This new error is repeatable, and can be eliminated by allowing these values to be"tweaked" and stored in a nonvolatile memory 62 connected to microcontroller 38. For example, if a test print page shows that the top margin is out of specifications, then an operator can use a software utility to adjust the stored values that microcontroller 38 uses to calculate position errors. These stored values represent the distance between paper sensor S1 and image transfer nip 50, and/or the length of transfer belt 30 between photoconductive drum 20 and image transfer nip 50. By adjusting the stored values, the image can be moved up or down on the page by the adjusted amount. These values are stored and used for any and all future print pages. Thus, the adverse effects of the manufacturing tolerances of media path 48 and transfer belt 30 can be eliminated.

Multiple feedback loops are used such that paper position errors introduced into the paper path can be effectively reduced in order to provide an accurate top writing line margin, and to allow the paper to be"handed-off" at an optimal speed into image transfer nip 50. Feedback from paper path sensors S1 and/or S2 and the signals from staging motor encoder 60 are used to determine and track paper position. Position error can then be calculated between paper and image. The speed of staging motor 36 is adjusted by microcontroller 38 to effectively remove the position error such that the paper arrives at image transfer nip 50 coincident with the image and at the desired speed. The speed of staging motor 36 is carefully controlled to provide acceptable power levels, acoustics and stability.

In order to minimize the initial top margin error, an accurate estimated pick time for each sheet of print media is needed. As shown in FIG. 1, associated with input media tray 34 is a pick roller assembly 70, including a pick motor 72. Also, associated with input media tray 35 is a pick roller assembly 74, including a pick motor 76. The estimated pick time is the length of time that microcontroller 38 estimates it will take from starting one of pick motors 72, 76 to when the sheet of print media reaches a known point, such as for example the location of paper path sensor S2.

If calculated pick times for sheets picked from the same source, such as input media tray 34, are available, the calculated pick times are used to formulate the estimated pick time for the current sheet located in media tray 34. Microcontroller 38 executes computer instructions for calculating the estimated pick time of the current sheet based on weighted multiple prior calculated pick times, wherein the highest weight is applied to the most recent prior calculated pick time so as to have the most impact on the outcome of the calculation for the estimated pick time of the current, i.e., next, sheet. For example, microcontroller 38 includes computer instructions for performing the mathematical equation:

$$EPT=CPT_1/2+CPT_2/4+CPT_3/4$$

wherein:

- EPT is the estimated pick time for the next sheet to be picked;
- $CPT_1$ is the calculated pick time for the immediately previous media sheet;
- $CPT_2$ is the calculated pick time for the second previous media sheet; and
- $CPT_3$ is the calculated pick time for the third previous media sheet.

As used herein, the estimated pick time (EPT) is the estimated length of time it will take to pick media from a particular source tray, such as one of input trays 34 and 35. The calculated pick time ($CPT_x$, wherein x is 1, 2 or 3) is the calculated length of time from when a pick motor, such as one of pick motors 72, 76, is started to when media path sensor S2 was made. Media path sensor S2 is"made" when media path sensor S2 senses a media sheet.

Of course, if the velocity of the transported media sheets remained constant, microcontroller 38 can arrive at calculated pick time by executing computer instructions to effect the following equation:

$$CPT_x=S2_{13}\ Made_TimeStamp-Pick_Start_TimeStamp$$

wherein:

- $CPT_x$ is the calculated pick time for a previous sheet,
- S2_Made_TimeStamp is the system time of printer 10 when media path sensor S2 is made, and
- Pick_Start_TimeStamp is the system time of printer 10 when one of pick motors 72, 76 is started.

However, as described above, the staging algorithm of the staging process controls the velocity of the transport of the media sheet in an attempt to minimize the top margin error.

Thus, using the equation, $CPT_x$=S2_Made_TimeStamp−Pick_Start_TimeStamp, for determining the values for arriving at values for each of calculated pick times $CPT_1$, $CPT_2$ and $CPT_3$ would introduce errors in the calculated pick time due to variations in the velocity of the transport of the media sheet.

For example, if a sheet of media reaches paper path sensor S1 early, i.e., the media is ahead of the image and would arrive early at the image transfer location of image transfer nip 50, the staging algorithm slows the media down before the media path sensor S2 is made, i.e., when media path sensor S2 senses a media sheet. Assuming a process speed of 20 pages per minute, the media traveling at 109.8 millimeters per second (mm/s) prior to executing the staging algorithm and slowing the media to 54.7 mm/s for 8 mm before media path sensor S2 is made, then the equation, $CPT_x$=S2_Made _TimeStamp−Pick_Start_TimeStamp, would result in a 73.4 milliseconds (ms) error in the calculated pick time, which would translate to a top margin error of about 8.1 mm.

As a further example, once the image reaches a distance away from the image transfer location of image transfer nip 50 that is equal to the distance from media path sensor S2 to image transfer nip 50, and if media path sensor S2 has not been made, then it is known that the media is late in relation to the location of the image to be transferred. In this case where the media sheet reaches media path sensor S2 late, i.e., the media sheet is behind the image and would arrive at the image transfer location late, the staging process increases the media sheet speed before the media sheet reaches paper path sensor S2. Assuming a process speed of 10 pages per minute, the media is traveling at 54.7 mm/s prior to executing the staging algorithm and the media is 25.4 mm behind the image, then the equation, $CPT_x$=$S2_{13}$ Made_TimeStamp−Pick_Start_TimeStamp, would result in 230 ms error in the calculated pick time, which would translate to 12.7 mm of top margin error.

Thus, if the staging algorithm of the staging process does modify the media sheet process speed before media path sensor S2 is made, then the calculated pick time needs to be compensated to reduce the error in arriving at a calculated pick time, and in turn, to reduce the error in arriving at the estimated pick time for the next media sheet to be picked, so as to reduce the initial top margin error. In such an event, microcontroller 38 includes computer instructions that are executed to effect the following equation to arrive at a compensated calculated pick time ($CPTcom_x$). The following equation performs the compensation by converting the distance over which the staging algorithm of the staging process was operating into a length of time by dividing it by the known normal process speed:

$CPTcom_x$=$Staging_{13}$ Encoders_From_Staging_Algorithm_Start_To_S2_Make/Staging_Encoders_ Per_Second_At_Normal_Process_Speed+Staging_Start_TimeStamp−Pick_Start_TimeStamp wherein:

$CPTcom_x$ is the compensated calculated length of time from a pick motor start to when media path sensor S2 is made for a previous sheet;

Staging_Encoders_From_Staging_Algorithm_ Start_To_S2_Make is the number of staging motor encoder pulses counted from when the staging algorithm of the staging process starts until media path sensor S2 is made (i.e., a distance);

Staging_Encoders_Per_Second_ At_Normal_Process_Speed is set to the number of encoder pulses per second that should occur if the staging motor was rotating at its current normal (no error correction) process speed;

$Staging_{13}$ $Start_{13}$ TimeStamp is the system time of printer 10 when the staging algorithm is started, since the staging motor may no longer match normal process speed; and Pick_Start_TimeStamp is the system time of printer 10 when the pick motor is started.

In the $CPTcom_x$ equation, it should be noted that two time periods are taken into account. First, the difference term"Staging_Start_ TimeStamp−Pick_Start_TimeStamp" provides a time period $t_1$ corresponding to the time at which the pick motor started to the time when the staging process started. Second, the quotient term"$Staging_{13}$ $Encoders_{13}$ From_$Staging_{13}$ $Algorithm_{13}$ Start_To_S2_Make/$Staging_{13}$ $Encoders_{13}$ Per_ Second_At_Normal_$Process_{13}$ Speed" provides a time derived period $t_2$ representative of a normalized time from when the staging process started to the time when media path sensor S2 was made. Thus, the compensated calculated pick time is the sum of time periods $t_1$ and $t_2$.

In a preferred embodiment of the present invention, the equation for calculating $CPTcom_x$ is used in arriving at values for each of individual calculated pick times $CPT_1$, $CPT_2$ and $CPT_3$ used in calculating estimated pick time EPT. Also, the preferred embodiment uses the individual calculated pick times of three consecutive prior media sheets in calculating estimated pick time EPT. Those skilled in the art will recognize, however, that equations $CPTcom_x$ and EPT may be modified and adapted to accommodate the use of any number or combination of one or more prior calculated pick times in determining an estimated pick time for a next media sheet without departing from the spirit and scope of the present invention.

For printer 10, the estimated pick time EPT is used to determine whether to pick first, or whether to image first. In printer 10, the location of the image on intermediate transfer medium belt 30 and the rate of rotation of intermediate transfer medium belt 30 are known. As such, it is further known the length of time that it will take for the image to reach the image transfer location at image transfer nip 50. Also, the velocity of a media sheet following the making of, i.e., sensing by, media path sensor S2 is known, and the time that it takes for the media sheet to travel from media path sensor S2 to reach the image transfer location at image transfer nip 50 is determined based on a normal process speed, i.e., nominal process velocity.

As an example of use of the estimated pick time EPT, assume it is known that the length of time that it will take for the image to reach the image transfer location at image transfer nip 50 is 3.0 seconds, and it is known that the time that it takes for the media sheet to travel from media path sensor S2 to reach the image transfer location at image transfer nip 50 is 0.5 seconds. Now, if the estimated pick time is 1.75 seconds, then it is necessary to begin imaging first, before picking, and to delay picking for 0.75 seconds, so that the image and the media sheet reach the image transfer location at image transfer nip 50 simultaneously. In contrast, if the estimated pick time is 2.75 seconds, then it is necessary to pick first, before imaging, and to delay imaging for 0.25 seconds, so that the image and the media sheet reach the image transfer location at image transfer nip 50 simultaneously.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for calculating a print medium pick time for an imaging apparatus that transports media at variable speeds along a media path, comprising the steps of:

providing a media path sensor for sensing an arrival of a media sheet at a known location along said media path;

providing an image on an image transfer member;

providing an image transfer location adjacent said media path;

providing a staging process for varying a transport velocity of said media sheet before transferring said image to said media sheet at said image transfer location, said staging process being used for positioning a top writing line margin of said media sheet in relation to said image at said image transfer location;

determining a time period $t_1$ corresponding to a time when a pick motor is started to pick said media sheet to a time when said staging process is started;

determining a derived time period $t_2$ representative of a normalized time from when said staging process is started to a time when said media path sensor senses said media sheet; and determining a compensated calculated pick time for said media sheet by summing said time period $t_1$ with said time period $t_2$.

2. The method of claim 1, wherein said time period $t_2$ is derived based on a quotient "$Staging_{13}$ $Encoders_{13}$ $From_{13}$ $Staging_{13}$ Algorithm_Start_To_S2_Make/$Staging_{13}$ $Encoders_{13}$ Per_ Second_At_Normal_$Process_{13}$ Speed", wherein:

"$Staging_{13}$ $Encoders_{13}$ From_$Staging_{13}$ $Algorithm_{13}$ Start_To_S2_Make" is a number of staging motor encoder pulses counted from when said staging process starts until said media path sensor detects said media sheet; and "$Staging_{13}$ $Encoders_{13}$ Per_Second_ At_$Normal_{13}$ $Process_{13}$ Speed" is set to a number of encoder pulses per second that should occur if a staging motor was rotating at a known normal process speed.

3. The method of claim 1, wherein each of the determining steps are repeated for each of a plurality of media sheets to determine an individual compensated calculated pick time for each of said plurality of media sheets.

4. The method of claim 3, further comprising the step of determining an estimated pick time (EPT) of a next media sheet based on a weighted average of said individual compensated calculated pick time for said each of said plurality of media sheets.

5. The method of claim 4, wherein said weighted average assigns a higher weight to an immediately previous one of said plurality of media sheets.

6. The method of claim 4, wherein said estimated pick time (EPT) is based on the formula:

$EPT=CPT_1/2+CPT_2/4+CPT_3/4$ wherein:

$CPT_1$ is a calculated pick time for an immediately previous media sheet, $CPT_2$ is a calculated pick time for a second previous media sheet, and $CPT_3$ is a calculated pick time for a third previous media sheet.

7. The method of claim 1, wherein each of the determining steps are performed for each of three consecutive media sheets to determine an individual compensated calculated pick time for each of said three consecutive media sheets.

8. The method of claim 7, further comprising the step of determining an estimated pick time (EPT) of a next media sheet based on a weighted average of said individual compensated calculated pick time for each of said three consecutive media sheets.

9. The method of claim 8, wherein said estimated pick time (EPT) is based on the formula:

$EPT=CPT_1/2+CPT_2/4+CPT_3/4$ wherein:

$CPT_1$ is a calculated pick time for an immediately previous media sheet, $CPT_2$ is a calculated pick time for a second previous media sheet, and $CPT_3$ is a calculated pick time for a third previous media sheet.

10. The method of claim 1, wherein each of the determining steps is performed by a microcontroller executing computer instructions.

11. A system for calculating a print medium pick time for an imaging apparatus that transports media at variable speeds along a media path, comprising:

a media path sensor for sensing an arrival of a media sheet at a known location along said media path;

an image transfer member for receiving an image;

an image transfer nip defining an image transfer location adjacent said media path;

staging means for executing a staging process for varying a transport velocity of said media sheet before transferring said image to said media sheet at said image transfer location, said staging process positioning a top writing line margin of said media sheet in relation to said image at said image transfer location;

means for determining a time period $t_1$ corresponding to a time when a pick motor is started to pick said media sheet to a time when said staging process is started;

means for determining a derived time period $t_2$ representative of a normalized time from when said staging process is started to a time when said media path sensor senses said media sheet; and means for summing said time period $t_1$ with said time period $t_2$ to determine a compensated calculated pick time for said media sheet.

12. The system of claim 11, wherein said time period $t_2$ is derived based on a quotient "$Staging_{13}$ $Encoders_{13}$ $From_{13}$ $Staging_{13}$ Algorithm_Start_To_S2_Make/$Staging_{13}$ $Encoders_{13}$ Per_ Second_At_Normal_Process_Speed", wherein:

"$Staging_{13}$ $Encoders_{13}$ $From_{13}$ $Staging_{13}$ Algorithm_ Start_To_S2_Make" is a number of staging motor encoder pulses counted from when said staging process starts until said media path sensor detects said media sheet; and "$Staging_{13}$ $Encoders_{13}$ Per_Second_ At_Normal_ Process_Speed" is set to a number of encoder pulses per second that should occur if a staging motor was rotating at a known normal process speed.

13. The system of claim 11, wherein said means for determining said time period $t_1$, said means for determining said derived time period $t_2$ and said means for summing determine an individual compensated calculated pick time for each of a plurality of media sheets.

14. The system of claim 13, further comprising means for determining an estimated pick time (EPT) of a next media sheet based on a weighted average of said individual compensated calculated pick time for said each of said plurality of media sheets.

15. The system of claim 14, wherein said weighted average assigns a higher weight to an immediately previous one of said plurality of media sheets.

16. The system of claim 14, wherein said estimated pick time (EPT) is based on the formula:

$EPT=CPT_1/2+CPT_2/4+CPT_3/4$ wherein:

$CPT_1$ is a calculated pick time for an immediately previous media sheet, $CPT_2$ is a calculated pick time for a second previous media sheet, and $CPT_3$ is a calculated pick time for a third previous media sheet.

17. The system of claim 11, wherein each of said means for determining said time period $t_1$, said means for determining said derived time period $t_2$ and said means for summing determine an individual compensated calculated pick time for each of three consecutive media sheets.

18. The system of claim 17, further comprising means for determining an estimated pick time (EPT) of a next media sheet based on a weighted average of said individual compensated calculated pick time for each of said three consecutive media sheets.

19. The system of claim 18, wherein said estimated pick time (EPT) is based on the formula:

$EPT=CPT_1/2+CPT_2/4+CPT_3/4$ wherein:

$CPT_1$ is a calculated pick time for an immediately previous media sheet, $CPT_2$ is a calculated pick time for a second previous media sheet, and $CPT_3$ is a calculated pick time for a third previous media sheet.

20. The system of claim 11, wherein each of said means for determining and said means for summing is a microcontroller that executes computer instructions.

21. A printer, comprising:

a media tray for holding media sheets;

a pick motor for picking a media sheet from said media tray;

a staging system including a staging motor operating in accordance with a staging process effecting a staging algorithm for transporting said media sheet along a media path;

a staging motor encoder coupled to said staging system for determining a distance traveled by said media sheet;

a sensor for sensing an arrival of said media sheet at a known location along said media path; and a microcontroller for executing computer instructions to determine a compensated calculated pick time ($CPTcom_x$) for said media sheet, said computer instructions effecting the equation:

$CPTcom_x$=$Staging_{13}$ $Encoders_{13}$ $From_{13}$ $Staging_{13}$ Algorithm_Start_To_S2_Make/$Staging_{13}$ $Encoders_{13}$ Per_Second_At_Normal_$Process_{13}$ Speed+ $Staging_{13}$ $Start_{13}$ TimeStamp−Pick_Start_TimeStamp wherein:

$Staging_{13}$ $Encoders_{13}$ From_$Staging_{13}$ $Algorithm_{13}$ Start_To_S2_Make is a number of staging motor encoder pulses counted from when said staging algorithm starts until said sensor detects said media sheet;

$Staging_{13}$ $Encoders_{13}$ Per_Second_ At_Normal_ $Process_{13}$ Speed is set to a number of encoder pulses per second that should occur if said staging motor was rotating at a known process speed;

$Staging_{13}$ $Start_{13}$ TimeStamp is a system time of said printer when said staging algorithm is started; and Pick_Start_TimeStamp is a system time of said printer when said pick motor is started.

22. The printer of claim 21, wherein said microcontroller determines an individual compensated calculated pick time ($CPTcom_x$) for each of a plurality of media sheets.

23. The printer of claim 22, wherein said microcontroller determines an estimated pick time (EPT) of a next media sheet based on a weighted average of said individual compensated calculated pick time ($CPTcom_x$)for said each of said plurality of media sheets.

24. The printer of claim 23, wherein said weighted average assigns a higher weight to an immediately previous one of said plurality of media sheets.

25. The printer of claim 22, wherein said plurality of media sheets is three prior consecutive media sheets.

26. The printer of claim 22, wherein said microcontroller determines an estimated pick time (EPT) of a next media sheet based on the formula:

$EPT=CPT_1/2+CPT_2/4+CPT_3/4$ wherein:

$CPT_1$ is a calculated pick time for an immediately previous media sheet, $CPT_2$ is a calculated pick time for a second previous sheet media, and $CPT_3$ is a calculated pick time for a third previous media sheet.

* * * * *